United States Patent [19]

Nicoloso

[11] 4,016,383

[45] Apr. 5, 1977

[54] SEALING DEVICE FOR AN ASSEMBLY OF ELEMENTS OF HIGH-VOLTAGE CUT-OUT DEVICES

[75] Inventor: Dante Nicoloso, Meyzieu, France

[73] Assignee: Delle-Alsthom, Villeurbanne, France

[22] Filed: May 2, 1975

[21] Appl. No.: 574,142

[30] Foreign Application Priority Data

May 20, 1974 France ..... 74.17453

[52] U.S. Cl. ..... 200/148 F; 200/146 AA

[51] Int. Cl.[2] ..... H01H 33/82

[58] Field of Search ..... 200/302, 337, 146 AA, 200/148 R, 148 F

[56] References Cited

UNITED STATES PATENTS

| | | | |
|---|---|---|---|
| 3,786,216 | 1/1974 | Beier | 200/148 R |
| 3,824,361 | 7/1974 | Noack | 200/148 F |
| 3,946,184 | 3/1976 | Yoshioka | 200/148 F |

*Primary Examiner*—Gerald P. Tolin
*Attorney, Agent, or Firm*—Sughrue, Rothwell, Mion, Zinn & Macpeak

[57] ABSTRACT

Sealing device for an assembly of elements of high-voltage cut-out devices comprising on the one hand, a cut-out chamber containing mobile elements integral with contact rods and on the other hand, an auxiliary chamber supporting the said cut-out chamber and crossed by an operating linkage for the mobile elements, the enclosures of the said chambers being fluid-tight and communicating together, characterized in that the operating linkage is fitted with seals providing, at the end of the stroke of the linkage, the independence of the said chambers and the sealing thereof with a view to their separation.

5 Claims, 5 Drawing Figures

SEALING DEVICE FOR AN ASSEMBLY OF ELEMENTS OF HIGH-VOLTAGE CUT-OUT DEVICES

The invention concerns cut-out devices having large dimensions which, for technical reasons, are transported from the manufacturing site to the installing site in separate elements, filled with a gaseous or liquid fluid. It applies, more particularly, to devices containing a gas under pressure, having high dielectric rigidity, such as sulphur hexafluoride.

DESCRIPTION OF THE PRIOR ART

For high voltages, these elements are constituted on the one hand, by cut-out devices which comprise, generally, one or several insulating supports containing the insulating operation rods and, on the other hand, at the top part of each support by a certain number of cut-out chambers. In operation, the support and the cut-out chambers are assembled in a fluid-tight manner. For transporting, it is an advantage, for reasons of bulk, to separate the insulating support from the assembly constituted by the cut-out chambers, especially if these chambers, when installed, are perpendicular to the support, this increasing the bulk.

But the installing of the filling fluid in the elements, the transporting of these latter and the assembling thereof on the installing site require precautions for preventing dampness from entering. In the case of a gas under pressure, a vacuum is firstly set up in the complete device, then the latter is filled with dry gas generally at a pressure lower than the operating pressure but slightly higher than the atmospheric pressure. This arrangement avoids during transport, dampness from entering and the danger of an accident which could be caused by a severe shock with filling at a higher pressure. The bringing of the single enclosure constituted by the support and the two-out chambers to operating pressure must be effected without the bringing in of dampness on the installing site. A monostat connected to the enclosure ensures that the pressure remains effectively comprised between the limits fixed.

SUMMARY OF THE INVENTION

The invention has as its object a device making it possible to produce before shipment, a single fluid-tight enclosure comprising the support and the cut-out chambers on which are effected the operations for forming a vacuum and filling, the mechanical and electrical controls and, with a view to reducing the bulk during transport, the separating without draining of the support on the one hand and of the cut-out chambers on the other hand, while maintaining the fluid-tight sealing of each of the elements and, lastly, at the installing site, the assembling, coupling and putting into communication of these elements without dampness entering therein, without any deflation and so as to constitute a single fluid-tight enclosure all of whose elements will be simultaneously put under operating pressure and for which the fluid-tight sealing of the assembly will be checked by a single manostat.

The invention has as its object a sealing device for an assembly of elements of high-voltage cut-out devices comprising, on the one hand, one or generally several cut-out chambers containing mobile elements integral with contact rods and, on the other hand, an auxiliary chamber supporting the said cut-out chamber or chambers and crossed by an operating linkage for the mobile elements, the enclosure of the said chambers being fluid-tight and communicating together, characterized in that the operating linkage is fitted with seals providing, at the end of the stroke of the linkage, the independence of the said chambers and the sealing thereof with a view to their separation.

According to one characteristic, the device comprises a means for moving the linkage beyond the end of its normal stroke, that extra movement placing the seals in a position in which the independence and the sealing of the chambers is provided.

According to another characteristic, each of the chambers comprises an intercommunication orifice during normal operation between the assembled chambers, that orifice enabling the forming of a vacuum, the filling and the controlling of the pressure of the assembly, the said orifice being stopped up by the seals due to the extra movement of the linkage.

The characteristics and advantages of the sealing device will become apparent from the description of an embodiment given by way of an example and illustrated in the drawings.

BRIEF DESCRIPTION OF THE DRAWINGS

In FIGS. 1 and 2, the two cut-out chambers 1 and 2 are connected together by a housing 3 installed on an insulating support constituted by an auxiliary chamber 4 inside which an insulating connecting rod 5 moves. The latter is driven by a jack 6 fixed to a housing 7 and connected to a control device by two pipes, (not shown). A rod 8 which couples the connecting rod 5 and the jack 6 crosses through a sealing element 9 which separates the inside of the isolator from the inside of the housing 7. The seals 10, 11 and 12 on the one hand and the seal 13 on the other hand ensure sealing respectively between the element 9 and the rod 8 and between the element 9 and the housing 7. An enclosure 14 which is arranged on the one hand between seals 11 and 18 and on the other hand between the seals 12 and 19 is filled with grease by a grease point 15; the grease is kept under pressure by a piston 16 and a spring 17.

Figure 1:
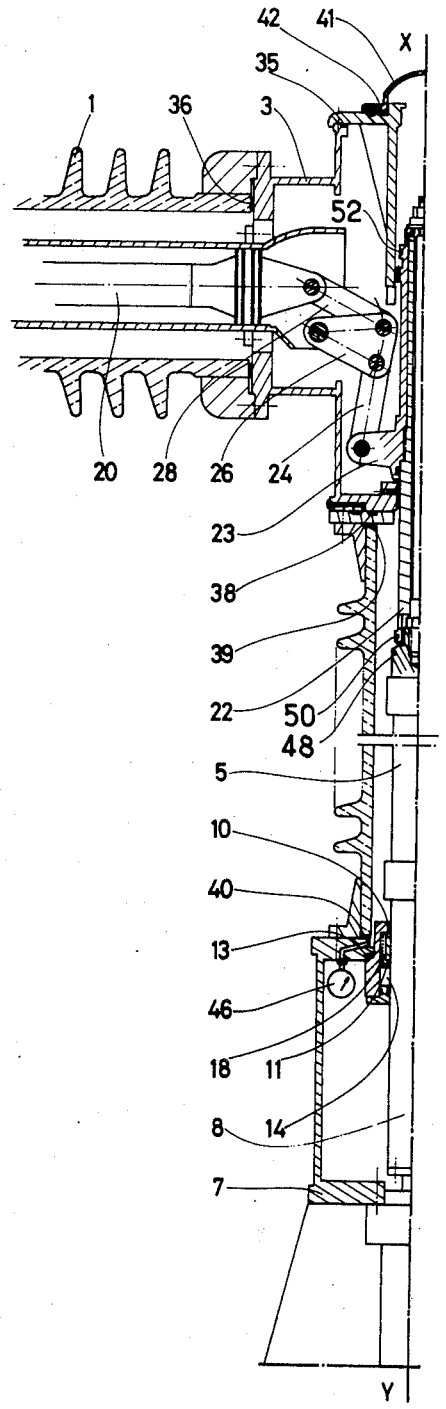
FIG. 1 is a half cut-away left-hand view through the axis XY of an assembly fitted with a sealing device according to the invention, in the open position.

During operations, the effort on the jack 6 is transmitted to mobile elements 20 and 21 arranged in the cut-out chambers 1 and 2 and integral with the contact rods, (not shown), through an operating linkage comprising the rod 8, the connecting rod 5 and a rod 22. The rod 22 actuates the elements 20 and 21 through a cross-bar 23, connecting rods 24 and 25, double levers 26 and 27 and connecting rods 28 and 29. A threaded rod 30 arranged inside the rod 22, a washer 31 and a nut 32 fix the connection between the connecting rod 5 and the cross-bar 23. The guiding of the rod 22 and of the cross-bar 23 is ensured by the journals 33 and 34.

The sealing of the assembly constituted by the two chambers 1 and 2 and their support 4 is ensured by the seals 10, 13, 35, 37, 38, 39, 40 as well as by a lid 41 and its seal 42.

DESCRIPTION OF THE PREFERRED EMBODIMENT

An orifice 43 leading out into a bore of a plate 49 integral with the chamber 4 and an orifice 44 leading into a bore of a flange 51 ensure a free communication of the gas between the cut-out chambers 1 and 2 and the chamber 4. A valve 45 enables the forming of a vacuum in the single enclosure and the filling of the latter with gas and a manostat controls the pressure thereof.

Figure 2:
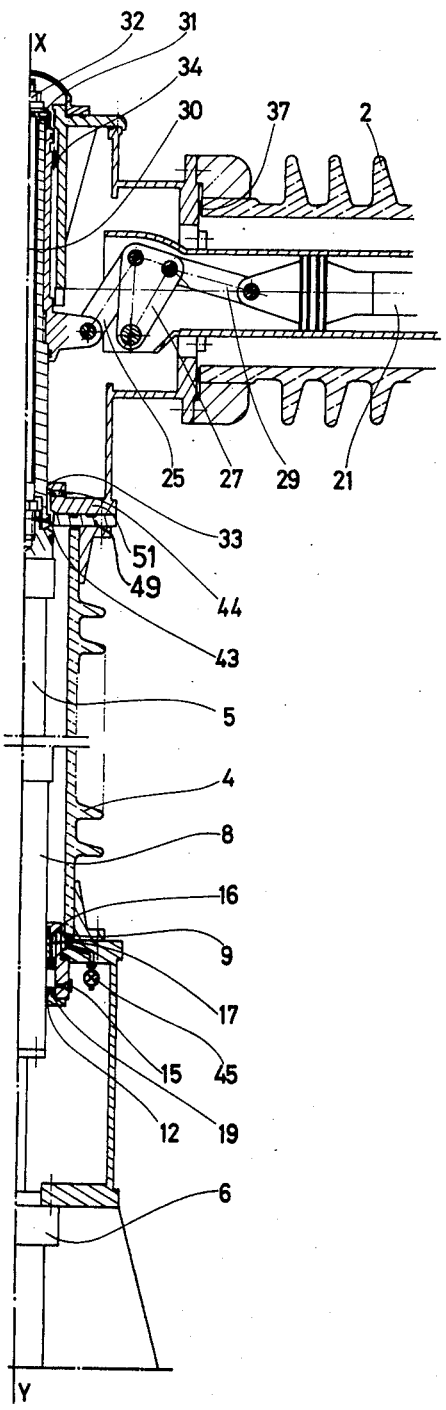
FIG. 2 is a half cut-away right-hand view of the assembly according to FIG. 1, in the closed position.
Figure 3:
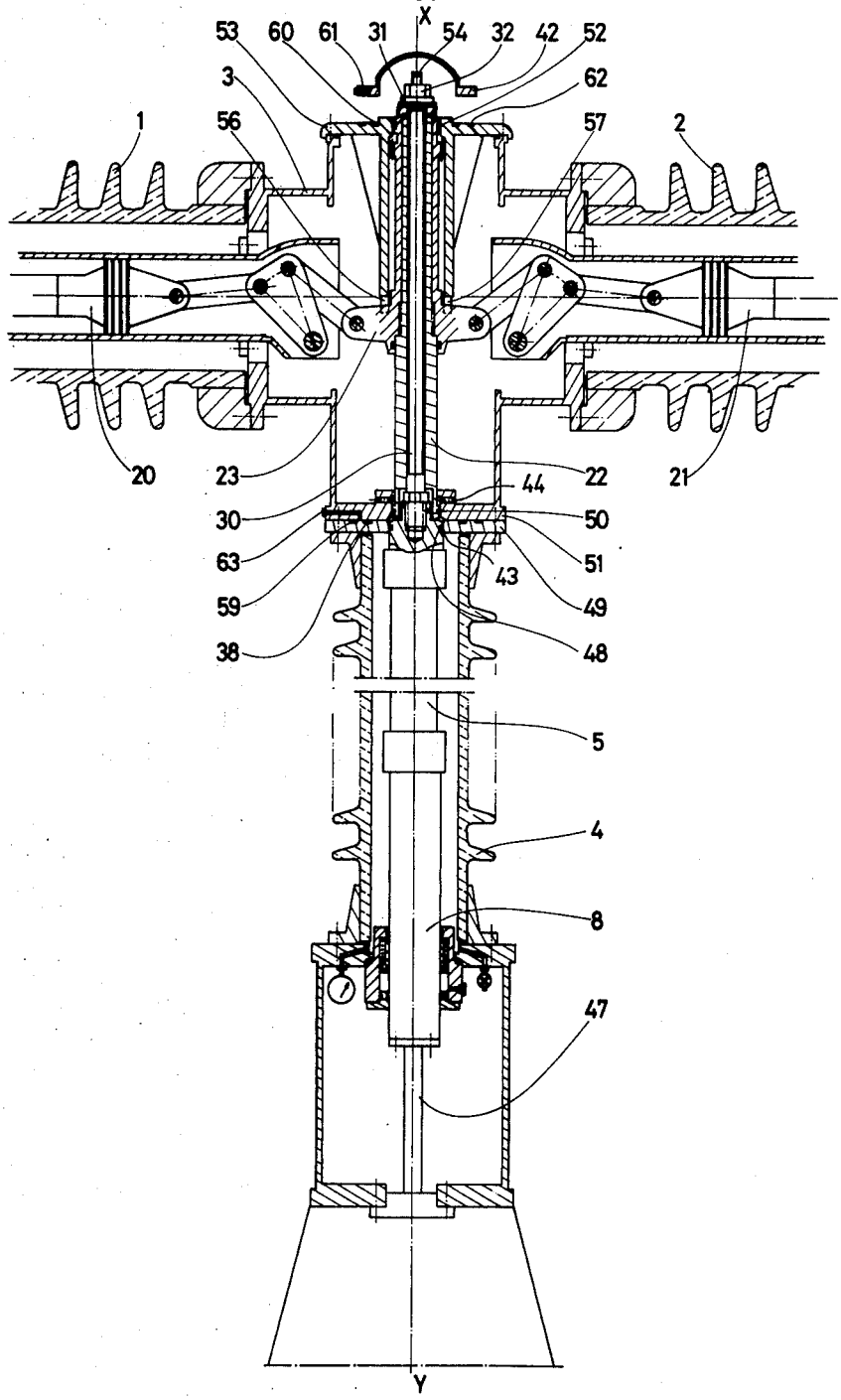
FIG. 3 is a cut-away view of the assembly according to FIG. 2 in which the sealing device is put into operation by the movement of the linkage.

In FIG. 3, the jack 6, which was abutting in the closed end of stroke position shown in FIG. 2, is replaced by a stop 47. The latter has made the rod 8 and the connecting rod 5 effect an extra stroke, beyond that closed position in normal operation and makes the contact rods of the mobile parts 20 and 21 slide in the fixed contacts, which are not shown. In these conditions, a seal 48 enters the bore of the plate 49 and blocks up the orifice 43, a seal 50 enters the bore of the flange 51 of the housing 3 and blocks orifice 43 and another seal 52 enters a bore of the lid 53.

The seals 48, 50 and 52 are not used for sealing in normal operation.

The single enclosure, previously obtained by the intercommunication in the assembly of the elements is thus divided into two fluid-tight enclosures, the one constituted by the chambers 1 and 2 and the housing 3 and the other by the auxiliary chamber 4. The connecting rod 5 is held by the stop 47. The lid 42 and the nut 32 and the washer 31 are then removed and the rod 30 and the connecting rod 5, then the rod 22 and the cross-bar 23, and thus successively released. During the unblocking of the nut 32, a wrench bearing against the flat surface 54 of the end of the rod 30 prevents the rotating of the latter.

Figure 4:
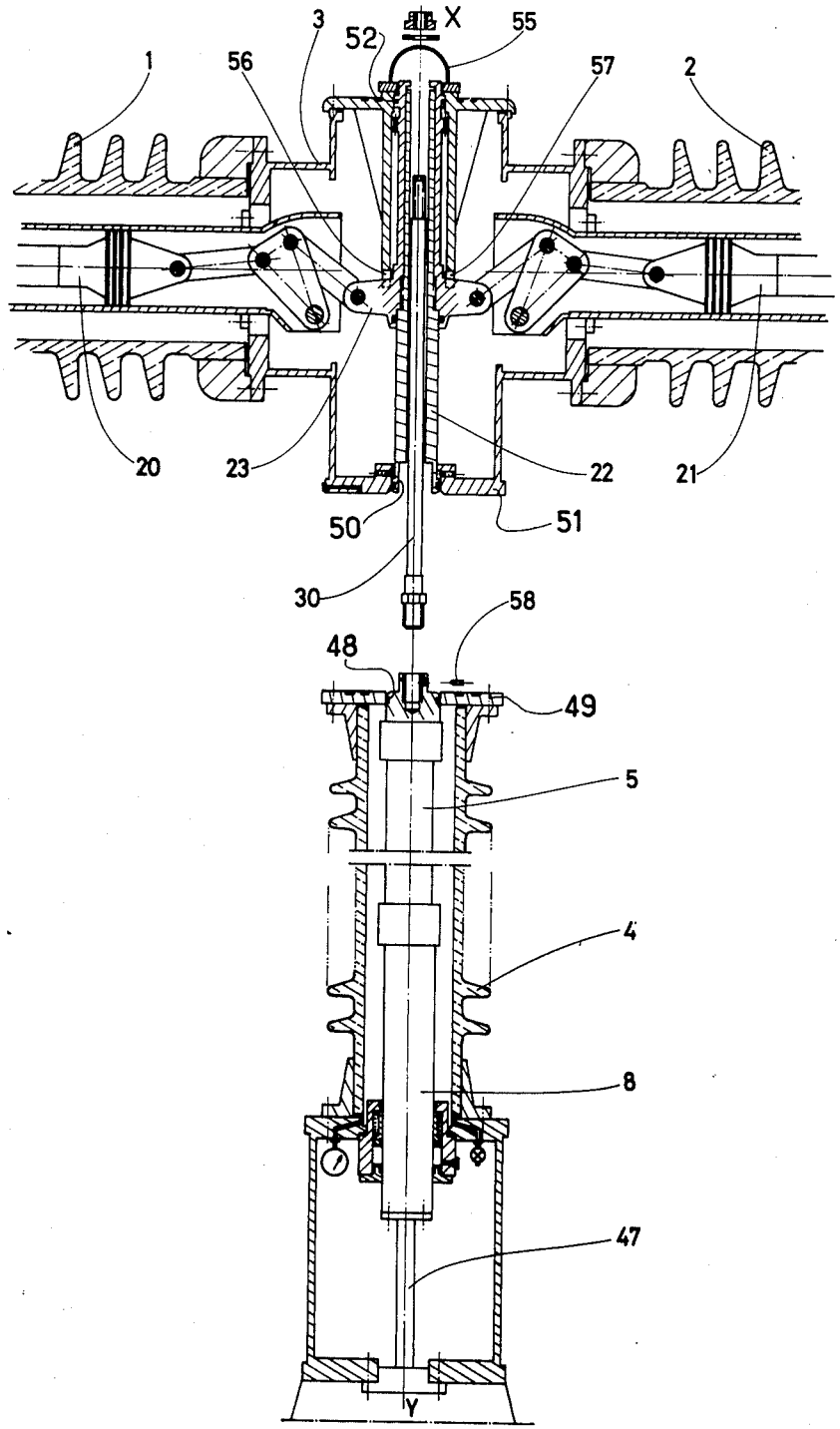
FIG. 4 is a sectional view which shows the separation of the components of the assembly, made fluid-tight by the sealing device.
Figure 5:
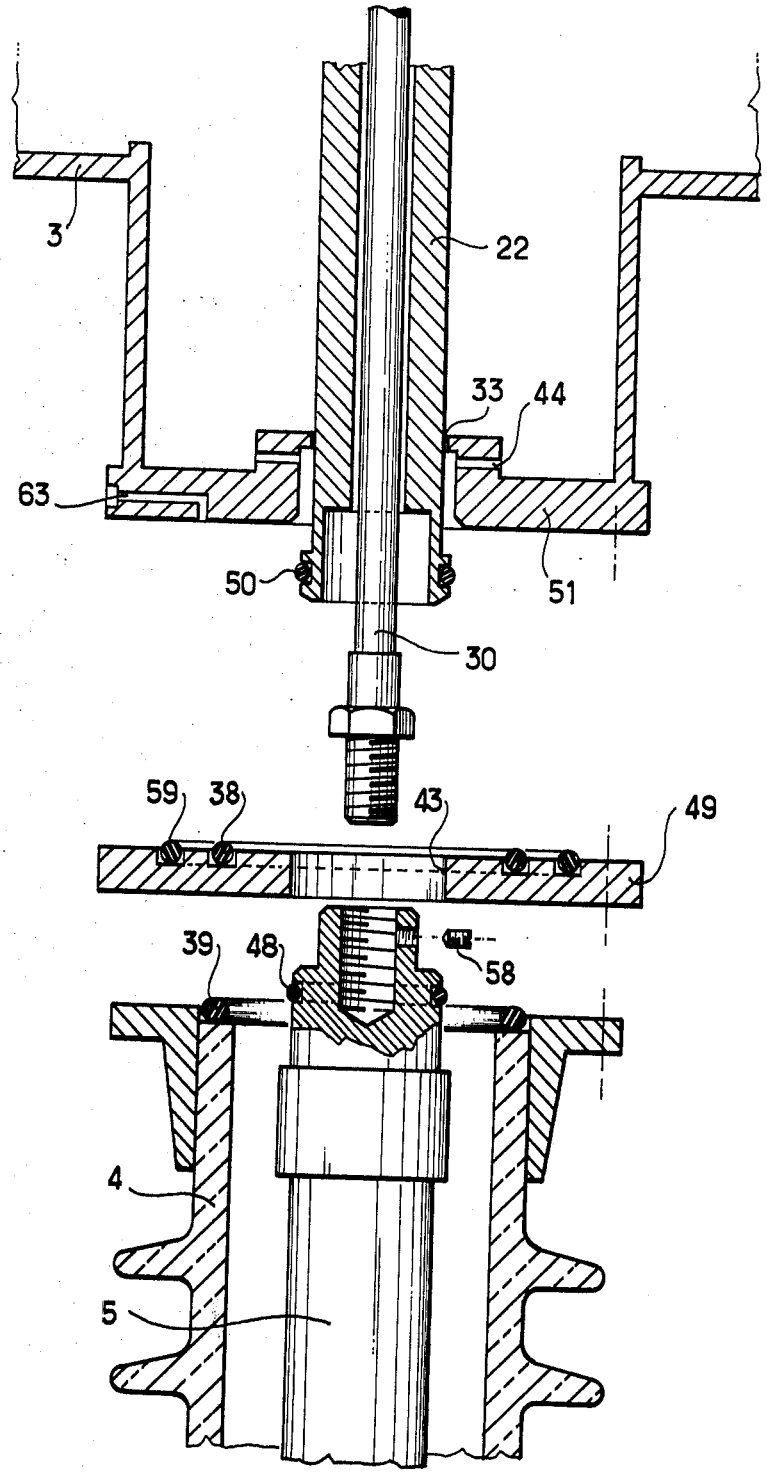
FIG. 5 is an enlarged exploded sectional view of a portion of the device of FIG. 1.

When these operations have been completed, the blocking of the cap screw 55 in FIG. 4 fixes the rod 22 on the housing 3 and the cross-bar 23 and gears their rotation together by means of the castellations 56 and 57. The mobile parts 20 and 21 are thus fixed.

The two fluid-tight assemblies can then be separated as shown in FIG. 4. For transport, the removal of the screw 58 makes it possible moreover to separate the rod 30 from the connecting rod 5.

When all the elements are brought together at the installing site, assembling is effected by carrying out the preceding operations in reverse. The device is assembled as shown in FIG. 3; the stop 47 is removed; the rod 8 is connected to the jack 6 and the communication is again established between the chambers 1 and 2 and the insulator 4 as shown in FIG. 2. According to one characteristic of the invention, after assembling, a double seal device makes it possible to check the sealing of the seals concerned in the separating and assembling of the elements. The seal 38 between the plate 49 of the insulator 4 flange and 51 of the housing 3 is tested by checking possible leakages at the orifice 63, sealing in relation to the atmosphere being ensured by the seal 59. Likewise, the seal 60 situated between the lids 42 and 53 is checked through the orifice 61, the seal 62 ensuring the sealing in relation to the atmosphere.

The main advantages of the device according to the invention are as follows:

A cut-out device having large dimensions can be separated into two sealed pre-inflated elements, making transport easier and enabling simple assembling on the installing site. All these operations are carried out without decrease in sealing and without dampness being allowed to enter.

A single orifice enables, on the complete device, the forming of a vacuum and inflating before transport and the setting to the optimum pressure after assembling on the installing site. A single manostat controls the pressure of the complete device;

Seal rings fixed on the mobile part do not come into action during normal operation;

The seal rings concerned in the assembling of the separate elements are double seals for scavenging leakage fluid, it being possible to check the sealing thereof on the installing site.

Although the device which has just been described may appear to afford the greatest advantages for implementing the invention, it will be understood that various modifications can be made thereto without going beyond the scope of the invention, it being possible to replace certain elements by other capable of fulfilling the same technical function or an equivalent technical function.

Moreover, the invention applies to a cut-out device comprising any number of auxiliary chambers bearing any number of cut-out chambers.

I claim:

1. In a high-voltage cut-out device including a first enclosure forming a sealed cut-out chamber, mobile elements integral with contact rods mounted within said cut-out chamber for movement between switch closed and switch open positions, a second enclosure defining a sealed auxiliary chamber, means for disconnectedly fluid tight mounting of said first enclosure onto said second enclosure and forming a communication passage therebetween and disconnectable linkage mounted within said enclosures, extending between said chambers through said passage, coupled to said mobile elements and movable between full stroke positions for operating said contact rods; the improvement wherein:

said linkage defines with respective enclosures orifices at said communication passage, and seals are carried by said linkage for closing off said orifices to effect a fluid tight seal between said linkage and said enclosures at one linkage full stroke position to permit separation of one enclosure from the other and disconnection of said linkage between said enclosures without loss of seal of either chamber.

2. The high-voltage cut-out device according to claim 1, wherein said linkage includes means for allowing additional movement of said seals subsequent to movement of said mobile elements within said sealed cut-out chamber to full switch contact open position of said contact rods to complete the fluid tight seal of said orifices.

3. The high-voltage cut-out device according to claim 2, wherein: said means defining said orifices further comprise means for filling and controlling the gas pressure of said high-voltage cut-out device in assembled or disassembled condition.

4. The high-voltage cut-out device according to claim 1, wherein: said seals comprise seal rings fixed to said linkage and positioned on said linkage such that they do not seal the orifices between said chambers during normal cut-out operation.

5. The high-voltage cut-out device according to claim 1, wherein: said seals comprise seal rings and constitute double seals and wherein means are provided for scavenging leakage fluid between respective double seals for checking chamber leakage on the installation site.

* * * * *